US007673487B2

(12) United States Patent
Oda

(10) Patent No.: US 7,673,487 B2
(45) Date of Patent: Mar. 9, 2010

(54) METHOD FOR FORMING HOLLOW SHAFT WITH A FLANGE AND PRODUCT WITH HOLLOW SHAFT FORMED BY THE SAME

(75) Inventor: Yoshitaka Oda, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 284 days.

(21) Appl. No.: 11/647,108

(22) Filed: Dec. 27, 2006

(65) Prior Publication Data

US 2007/0151317 A1 Jul. 5, 2007

(30) Foreign Application Priority Data

Dec. 28, 2005 (JP) ..... 2005-380262

(51) Int. Cl.
*B21D 28/00* (2006.01)

(52) U.S. Cl. ..... 72/335; 72/333; 72/379.2

(58) Field of Classification Search ..... 72/326, 72/327, 333, 335, 348, 356, 379.2, 325, 332, 72/404

See application file for complete search history.

(56) References Cited

U.S. PATENT DOCUMENTS

| | | | | | |
|---|---|---|---|---|---|
| 4,070,895 | A * | 1/1978 | Yamada et al. | ..... | 72/334 |
| 4,114,417 | A * | 9/1978 | LaVene | ..... | 72/297 |
| 4,165,629 | A * | 8/1979 | McCabe | ..... | 72/325 |
| 5,237,849 | A * | 8/1993 | Miyazawa | ..... | 72/335 |
| 5,501,092 | A * | 3/1996 | Miyazawa et al. | ..... | 72/43 |
| 5,797,291 | A * | 8/1998 | Yamada | ..... | 72/344 |
| 5,867,253 | A * | 2/1999 | Nakae | ..... | 355/52 |
| 5,921,130 | A * | 7/1999 | Yamada | ..... | 72/358 |
| 6,460,394 | B2 | 10/2002 | Hidaka et al. | | |
| 6,959,479 | B2 * | 11/2005 | Yamanaka et al. | ..... | 29/525.01 |
| 7,296,456 | B2 * | 11/2007 | Ushida | ..... | 72/356 |

FOREIGN PATENT DOCUMENTS

| | | |
|---|---|---|
| JP | 59-016639 | 1/1984 |
| JP | 61-060217 | 3/1986 |
| JP | 03-128131 | 5/1991 |
| JP | 10-296364 | 11/1998 |
| JP | 2000-288668 | 10/2000 |
| JP | 2002-28740 | 1/2002 |
| JP | 2003-001348 | 1/2003 |
| JP | 3475551 | 12/2003 |
| JP | 2004-330285 | 11/2004 |

* cited by examiner

*Primary Examiner*—Edward Tolan
(74) *Attorney, Agent, or Firm*—Nutter McClennen & Fish LLP; John J. Penny, Jr.

(57) ABSTRACT

There is provided a method for forming a hollow shaft with a flange directly in sheet metal. This method is a method for forming a hollow shaft having a flange portion 17 at the end thereof based on stamping performed on sheet metal 20. The method includes forming an upright portion 14 which is upright with respect to the surface of the sheet metal 20 by using a burring punch 320 and a burring die 310, and bending outward the free end portion of the upright portion 14 radially with respect to the central axis of the cylindrical portion by using a bending punch and a bending die. Here, the formed hollow shaft has the upright portion 14 protruding upright with respect to the surface and the flange portion 17 radially extending from the end of the upright portion.

3 Claims, 19 Drawing Sheets

130

METHOD FOR FORMING HOLLOW SHAFT WITH A FLANGE AND PRODUCT WITH HOLLOW SHAFT FORMED BY THE SAME

CROSS REFERENCE TO RELATED APPLICATION

The present application claims priority from a Japanese Patent Application No. 2005-380262 filed on Dec. 28, 2005, the contents of which are incorporated herein by reference.

BACKGROUND

1. Technical Field

The present invention relates to a method for forming a hollow shaft and a product with a hollow shaft manufactured by the same. More specifically, the present invention relates to a method for forming a hollow shaft, which enables a hollow shaft with a flange to be directly formed in sheet metal by performing stamping (pressing) process on the sheet metal.

2. Related Art

Japanese Patent No. 3475551 discloses a method for forming a hollow shaft which protrudes from sheet metal by performing stamping process on the sheet metal. According to this Japanese Patent No. 3475551, the shaft can be formed in the sheet metal by way of stamping process which includes a first step of half-blanking the sheet metal based on stamping process and a second step of holding in a die the protruding portion obtained in the first step, putting a punch into the protruding portion, and pressing the protruding portion in an opposite direction to the direction of putting the punch into the protruding portion.

This type of metal-processed products is used in such a manner that the product with the shaft is attached to a certain member or a certain part is attached to the shaft. In this case, it is desired to prevent the attached product or part from being detached. However, the technique disclosed in the above-mentioned patent document 1 only forms a simple cylindrical shaft having a constant diameter. Accordingly, the usage of the shaft produced by this technique is seriously limited when the shaft is jointly utilized in combination with other members or parts.

SUMMARY

In view of the above, an advantage of some embodiments of the present invention is to provide a method for forming a hollow shaft which can solve the above-mentioned problem. Another advantage is to provide a product with a hollow shaft formed by the forming method. This advantage is achieved by combining the features recited in the independent claims. The dependent claims define further effective specific example of the present invention.

A first embodiment of the present invention provides a method for forming a hollow shaft having a flange at an end thereof in sheet metal based on stamping performed on the sheet metal. The method includes forming a cylindrical portion which is upright with respect to a surface of the sheet metal by using a burring punch and a burring die, and bending outward a free end portion of the cylindrical portion radially with respect to a central axis of the cylindrical portion by using a bending punch and a bending die. Here, the formed hollow shaft has an upright portion protruding upright with respect to the surface and a flange portion radially extending from an end of the upright portion.

A second embodiment of the present invention provides a product with a hollow shaft. Here, the hollow shaft has an upright portion protruding upright with respect to a surface of sheet metal and a flange portion which radially extends from an end of the upright portion, and the hollow shaft is formed by processing the sheet metal based on stamping. Here, the processing includes forming a cylindrical portion which is upright with respect to the surface of the sheet metal by using a burring punch and a burring die, and bending outward a free end portion of the cylindrical portion radially with respect to a central axis of the cylindrical portion by using a bending punch and a bending die.

Here, all the necessary features of the present invention are not listed in the summary. The sub-combinations of the features may become the invention.

DESCRIPTION OF EXEMPLARY EMBODIMENTS

Hereinafter, one aspect of the present invention will be described through some embodiments. The embodiments do not limit the invention according to the claims, and all the combinations of the features described in the embodiments are not necessarily essential to means provided by aspects of the invention.

Figure 1:
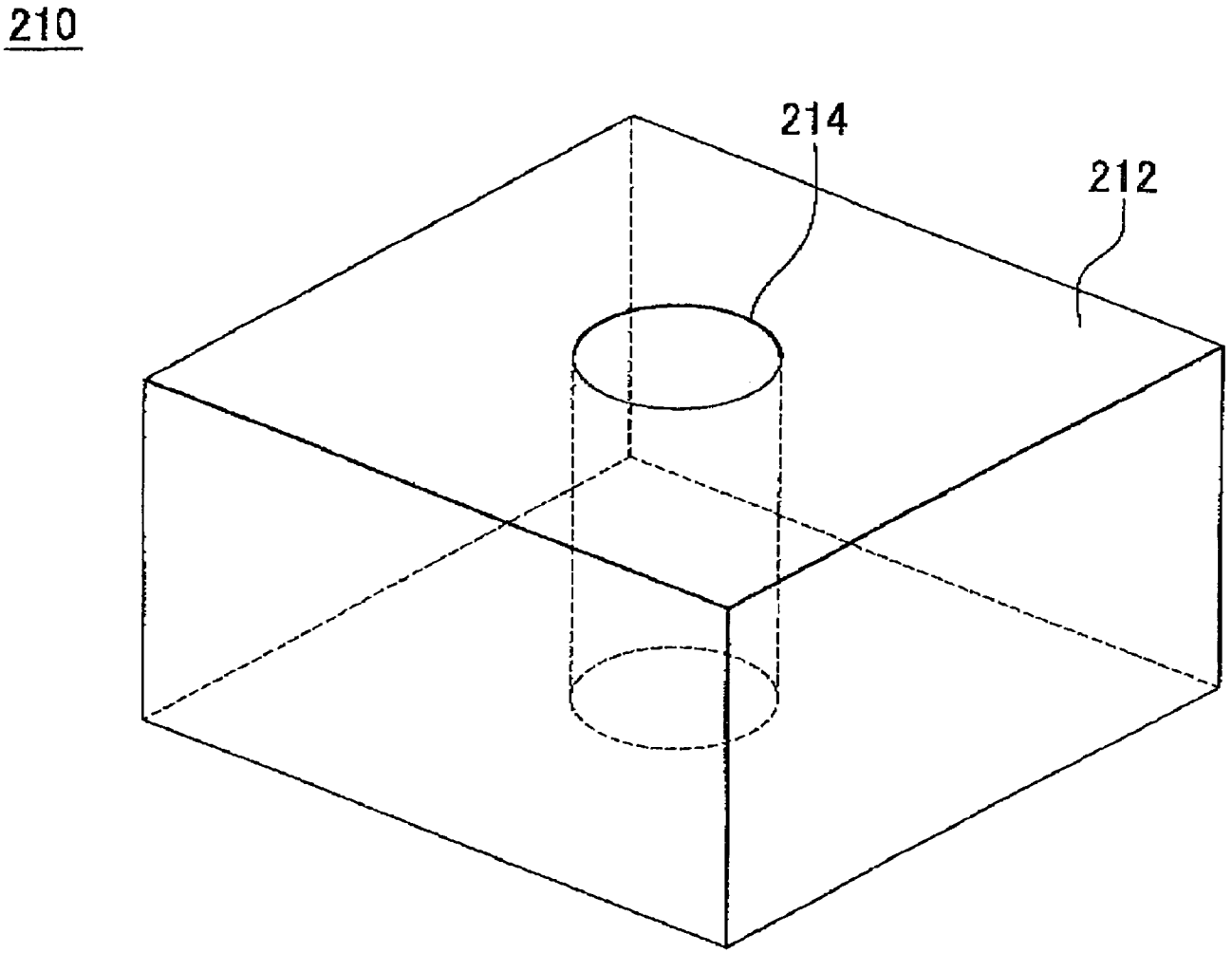
FIG. 1 is a perspective view illustrating the shape of a blanking die 210 to be used in a blanking step.

FIG. 1 illustrates the shape of a blanking die 210 to be used in a blanking step that is performed prior to a protrusion process step. As shown in FIG. 1, the blanking die 210 is a cubic solid-core metal block 212 as a whole, and has therein a through hole 214 penetrating the metal block 212 from its front to bottom surfaces in the center thereof. The through hole 214 has a circular shape in the horizontal cross section.

Figure 2:
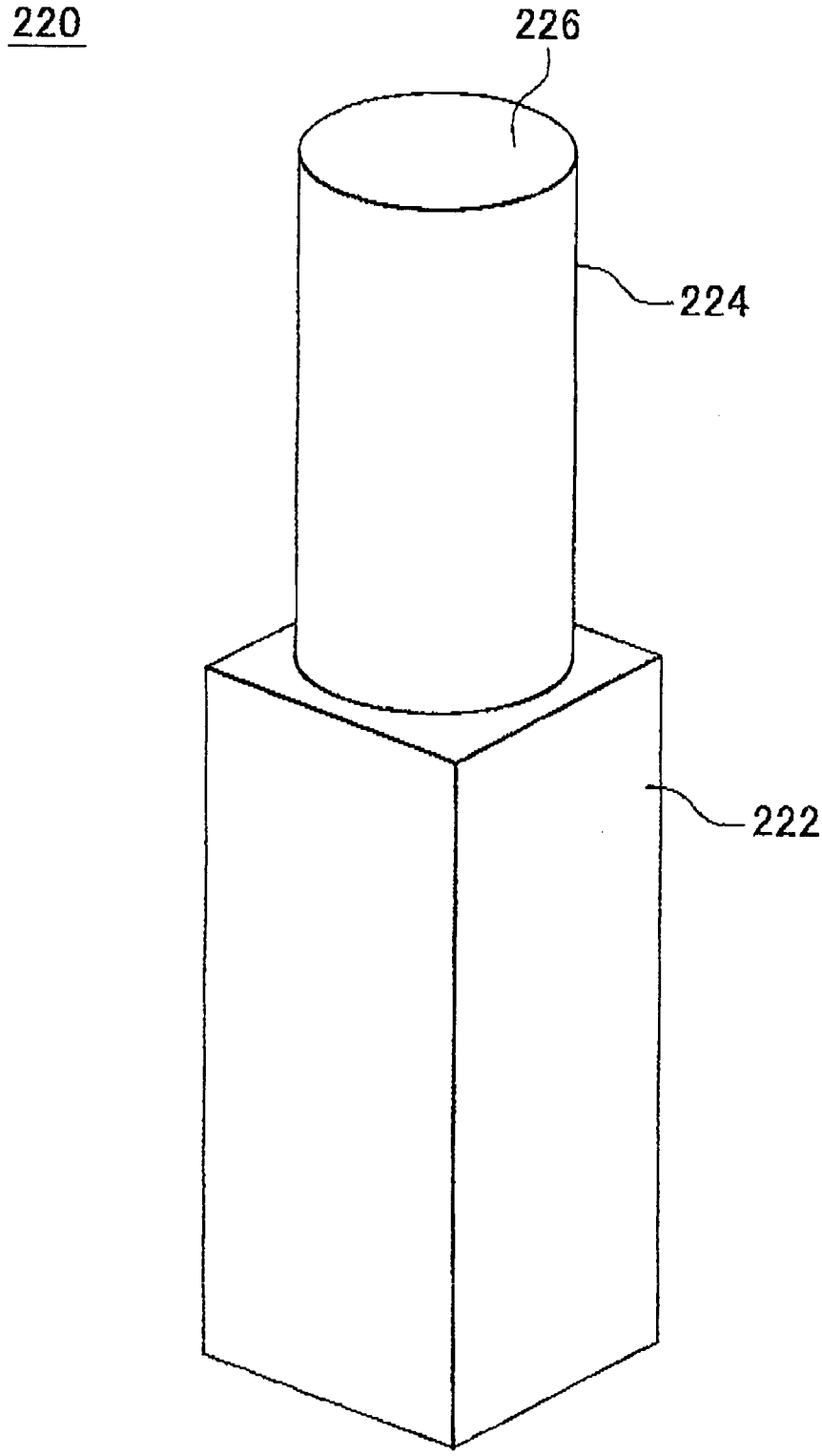
FIG. 2 is a perspective view illustrating the shape of a blanking punch 220 to be used in the blanking step.

FIG. 2 is a perspective view illustrating the shape of a blanking punch 220 to be used in combination with the blanking die 210 shown in FIG. 1. The blanking punch 220 has a pressing portion 222 having a quadrangular-prism-like shape, and a blanking portion 224 that has a circular cross-section complementary to the cross-section of the through hole 214 of the blanking die 210. Here, the base 226 of the blanking portion 224 has a sharp edge. Note that the dimensions of the blanking portion 224 are designed so as to allow a proper space to be formed for the blanking process when the blanking portion 224 is inserted into the through hole 214.

When attached to a forming apparatus, the blanking die and punch 210 and 220 having the above-described configurations are relatively positioned so that the blanking portion 224 of the blanking punch 220 smoothly enters into the through hole 214 of the blanking die 210. Furthermore, sheet metal, in which a desired hollow shaft is to be formed, is placed on the surface of the blanking die 210. Here, the position of the sheet metal is adjusted so that the center of the through hole 214 of the blanking die 210 coincides with the center of the desired hollow shaft. After the above positioning, the blanking punch 220 is moved down to enter into the through hole 214, so that a portion of the sheet metal is cut out. The cut-out portion has the same shape as the base 226 of the blanking punch 220.

Figure 3:
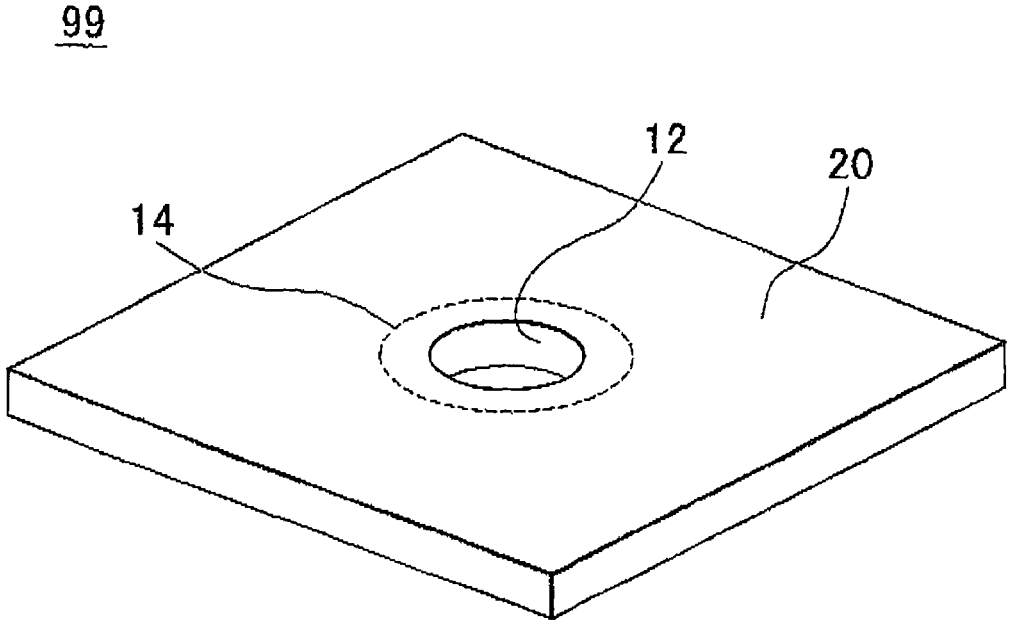
FIG. 3 is a perspective view illustrating the shape of a work 99 which is obtained as a result of the blanking process performed in the blanking step.

FIG. 3 is a perspective view illustrating the shape of a work 99 in which an opening 12 has been formed by the above-described blanking process. As shown in FIG. 3, the work 99 at this stage is sheet metal 20 which has the opening 12 formed in the center thereof. At this stage, the inner diameter of the opening 12 is smaller than the diameter of an upright portion 14 which constitutes the desired hollow shaft. In this way, the above-described process can provide a material which is satisfactorily used to form the upright portion 14 in a protrusion process step explained later. Note that the sheet metal 20 may be a cold-rolled steel sheet (SECC) having a thickness of 1.2 mm, for example.

Figure 4:
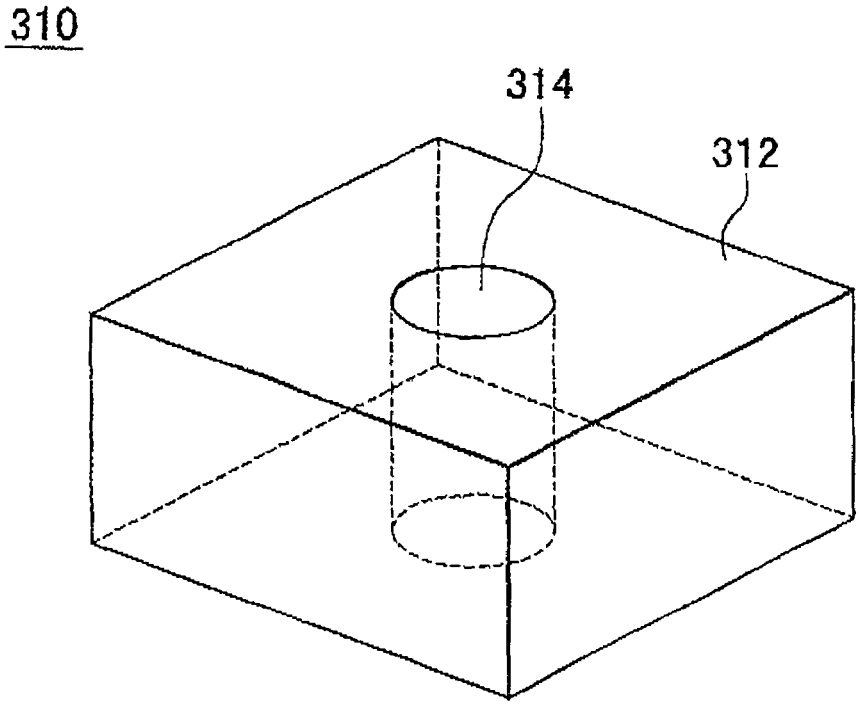
FIG. 4 is a perspective view illustrating the shape of a burring die 310 to be used in a protrusion process step.

FIG. 4 is a perspective view illustrating the shape of a burring die 310 to be used in the following protrusion process step. As shown in FIG. 4, the burring die 310 is also formed by a cubic metal block 312, and has a through hole 314 having a cylindrical shape in the center thereof. Here, the inner diameter of the through hole 314 is substantially equal to the outer diameter of the upright portion of the desired hollow shaft.

Figure 5:
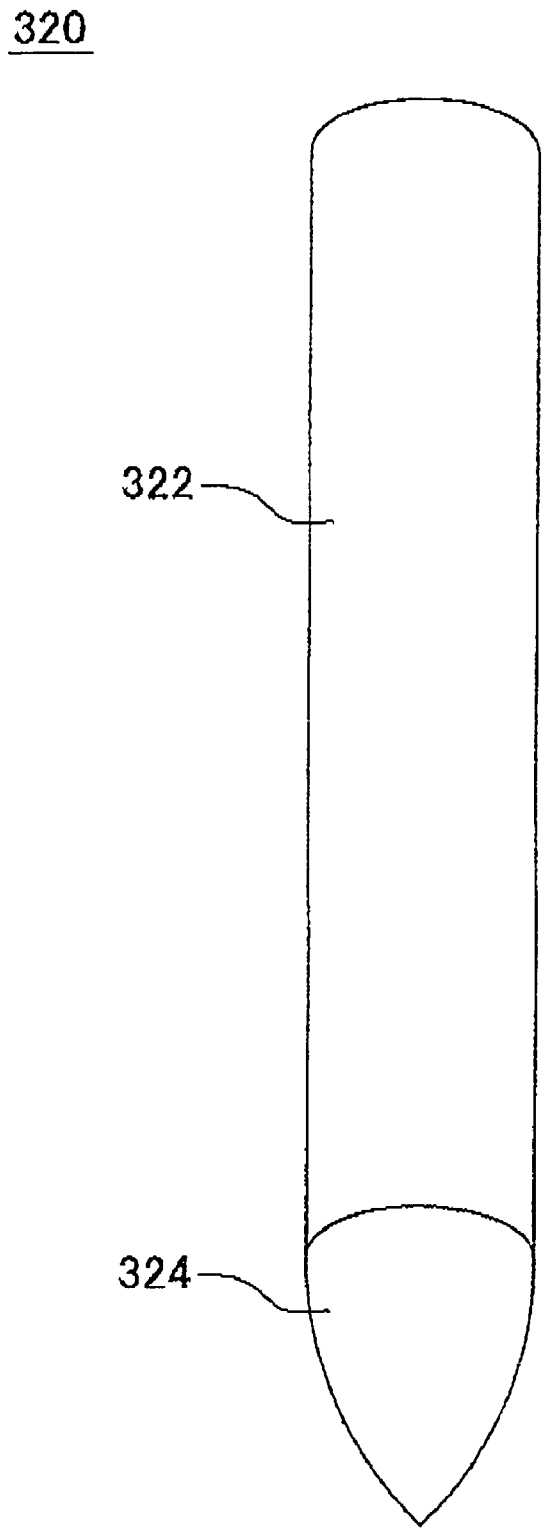
FIG. 5 is a perspective view illustrating the shape of a burring punch 320 to be used in the protrusion process step.
Figure 6:
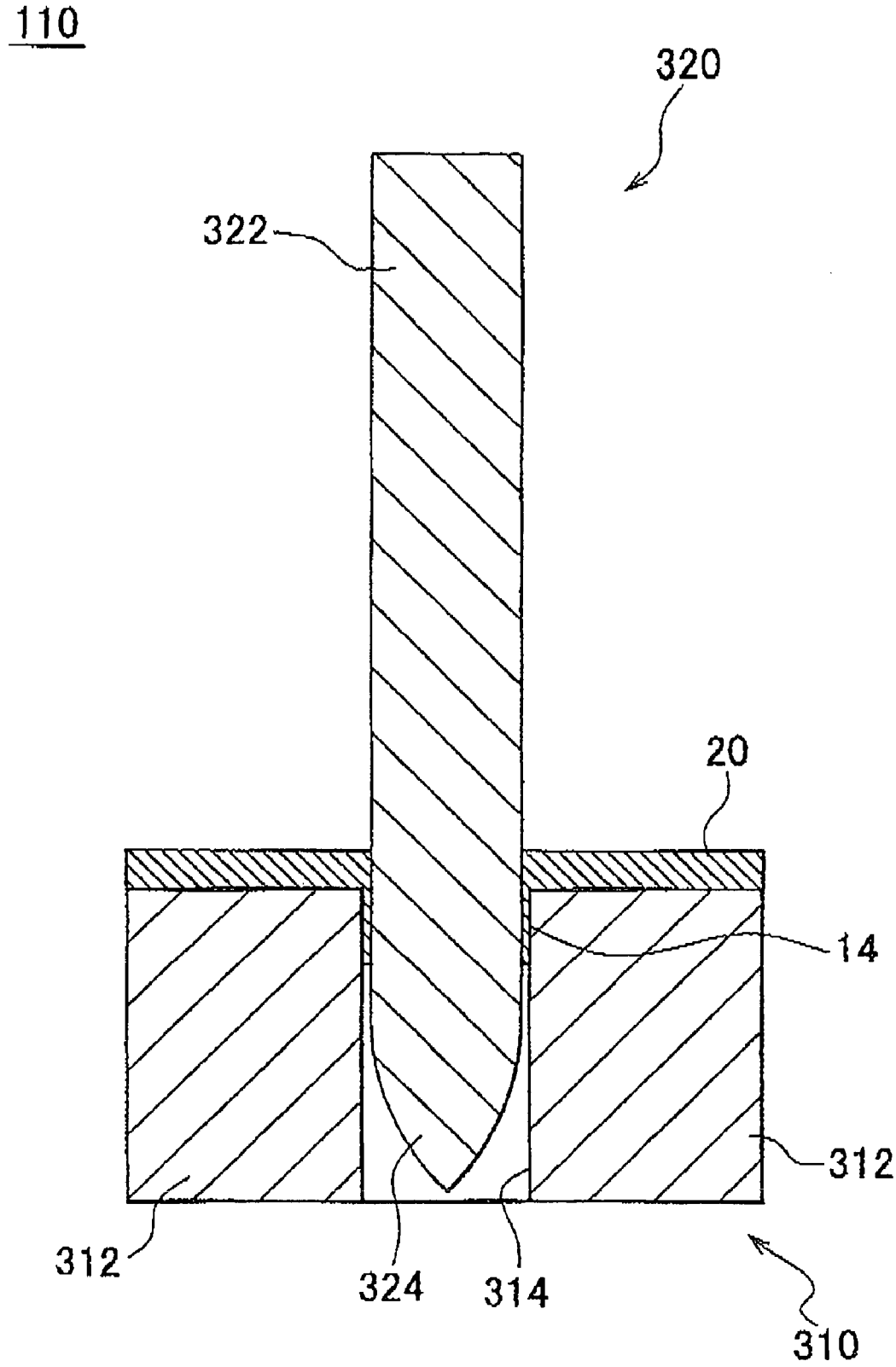
FIG. 6 is a perspective view illustrating the shape of the work 99 on which the protrusion process is being performed in the protrusion process step.

FIG. 5 is a perspective view illustrating the shape of a burring punch 320 to be used in combination with the burring die 310 shown in FIG. 4. As shown in FIG. 5, the burring punch 320 has a straight trunk portion 322 having a cylindrical shape with a constant diameter, and a bullet-shaped tip portion 324 formed at one end of the straight trunk portion 322. The outer diameter of the straight trunk portion 322 is substantially equal to the inner diameter of the upright portion of the desired hollow shaft. v FIG. 6 is a cross-sectional view illustrating how the work 99 is processed by a forming apparatus 110 attached with the above-described burring die and punch 310 and 320. As shown in FIG. 6, the burring punch 320 is inserted into the through hole 314 of the burring die 310, to process a portion of the work 99 which surrounds the opening 12. In this way, the upright portion 14, which eventually results in the hollow shaft, is formed.

Figure 7:
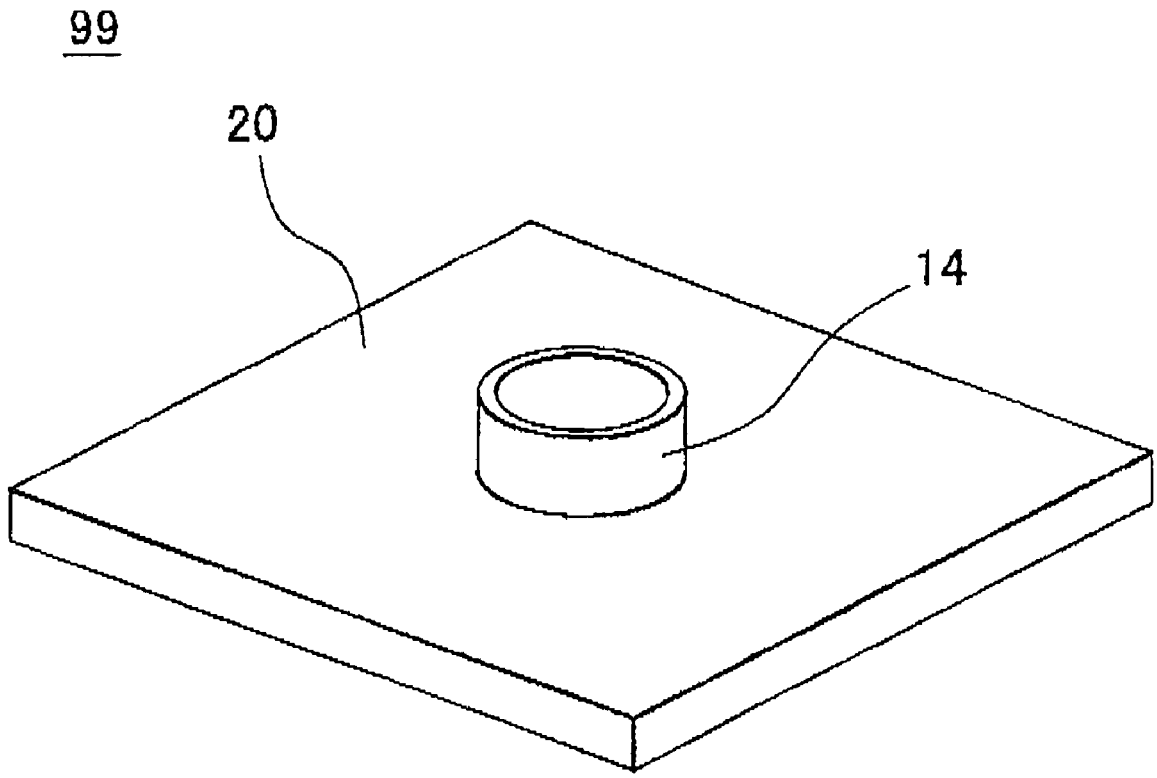
FIG. 7 is a perspective view illustrating the shape of the work 99 which is obtained as a result of the protrusion process performed in the protrusion process step.

FIG. 7 is a perspective view illustrating the shape of the work 99 which is obtained as a result of the above-described process. As shown in FIG. 7, the cylindrical upright portion 14 is formed so as to protrude upright from the surface of the sheet metal 20. It should be noted that, in the present embodiment, the subsequent bending process step includes a preliminary bending process step and a finishing bending process step which are separately performed.

Figure 8:
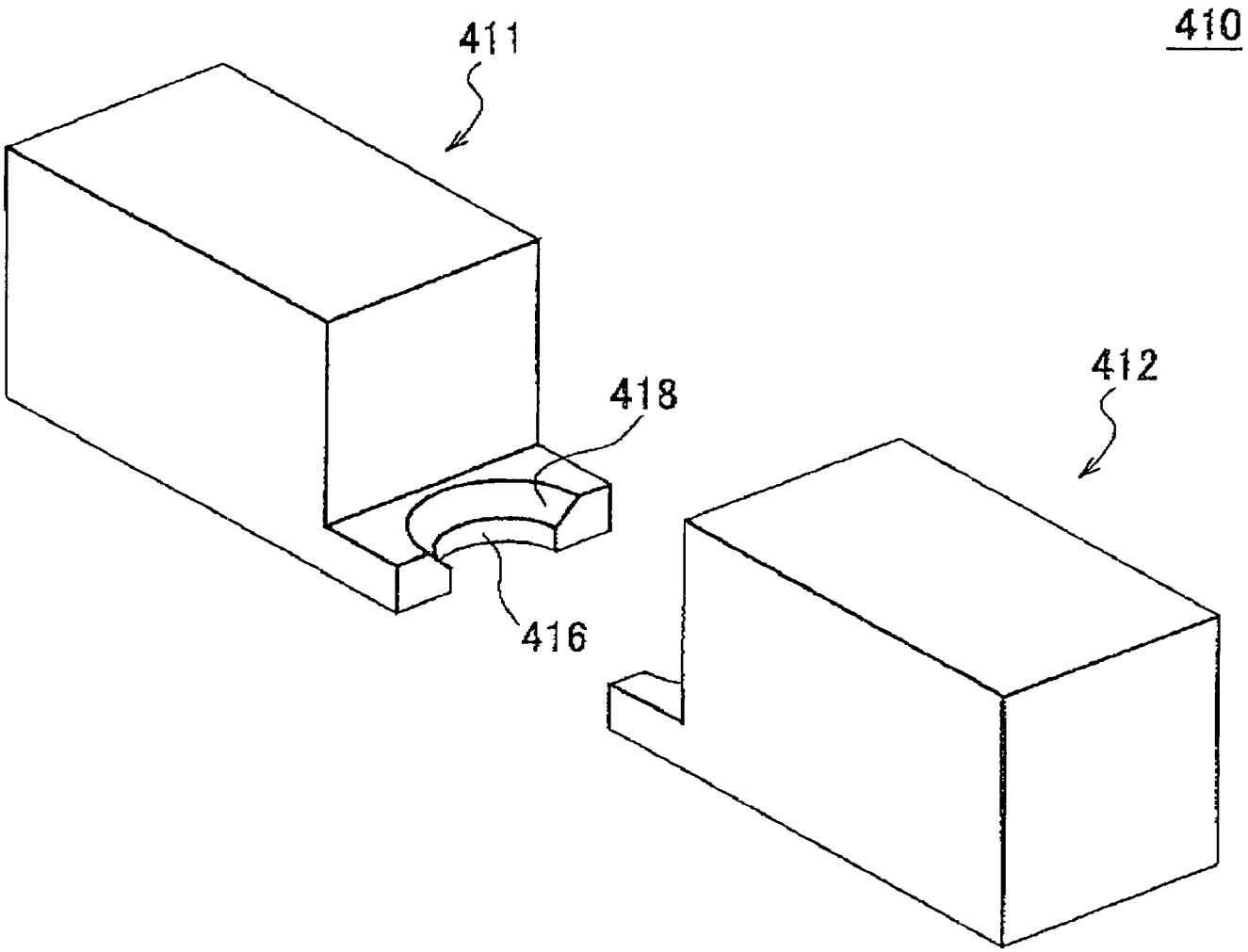
FIG. 8 is a perspective view illustrating the shape of a preliminary bending die 410 to be used in a preliminary bending process step.

FIG. 8 is a perspective view illustrating the shape of a preliminary bending die 410 to be used in the preliminary bending process step. As shown in FIG. 89, the preliminary bending die 410 includes a pair of divided dies 411 and 412 each of which has a semicircular process surface 418. When the divided dies 411 and 412 are contacted to each other in such a manner that the side surfaces including the process surfaces 418 face each other, the process surfaces 418 form a circular process surface at an angle of 45° with respect to the horizontal plane. Also, support surfaces 416 form a support surface which is adjacent to the circular process surface and positioned immediately below the circular process surface. It should be noted here that the inner diameter of a circle formed by the pair of support surfaces 416 is equal to the outer diameter of the upright portion 14 formed in the work 99 which is shown in FIG. 7.

Figure 9:
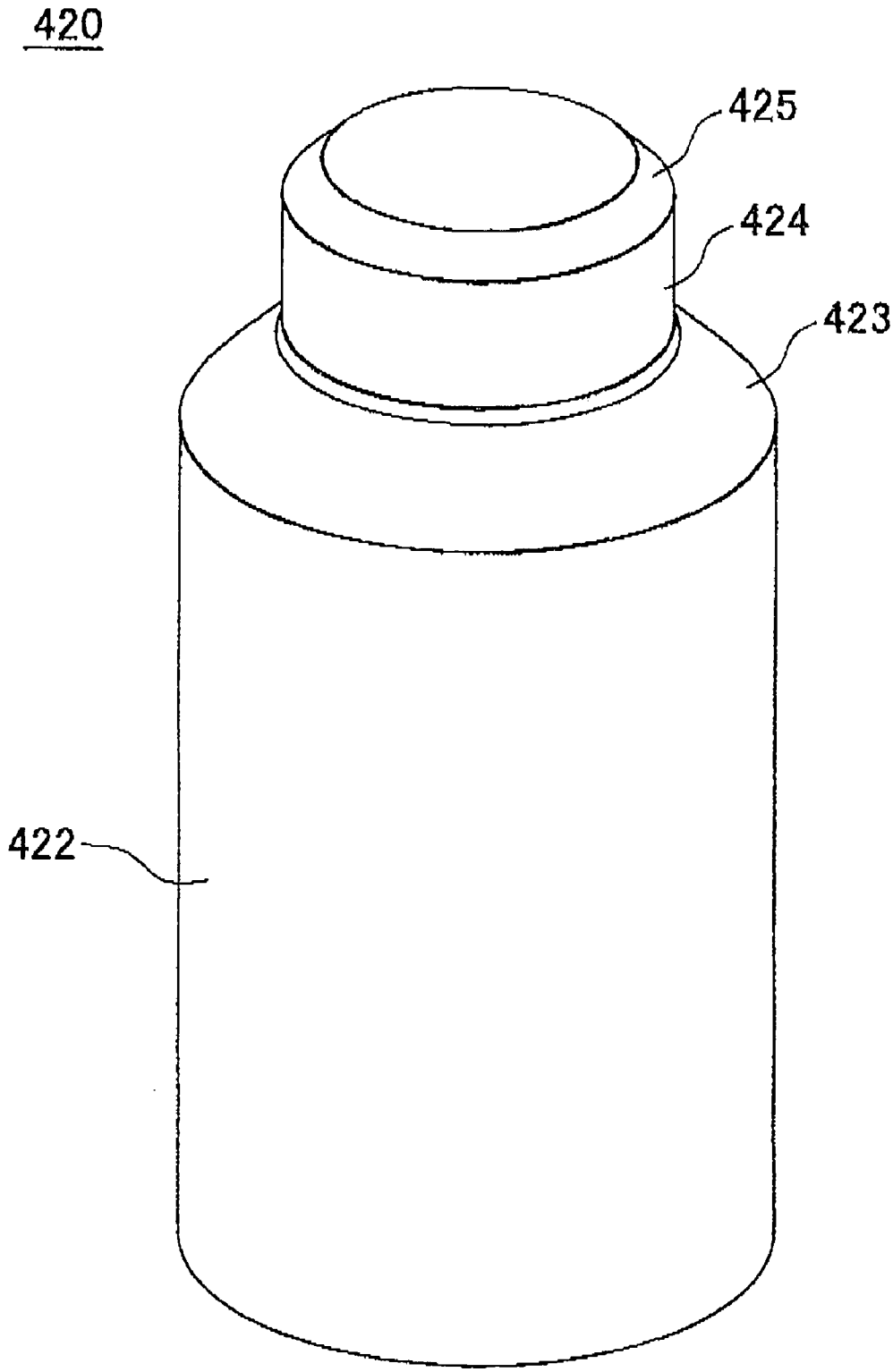
FIG. 9 is a perspective view illustrating the shape of a preliminary bending punch 420 to be used in the preliminary bending process step.

FIG. 9 is a perspective view illustrating the shape of a preliminary bending punch 420 to be used in combination with the preliminary bending die 410. As shown in FIG. 9, the preliminary bending punch 420 has a circular shape in the horizontal cross-section throughout itself. The preliminary bending punch 420 has a cylindrical straight trunk portion 422, and an inserting portion 424 which is formed at one end of the straight trunk portion 422 and has a smaller diameter than the straight trunk portion 422. At the end of the straight trunk portion 422 at which the inserting portion 424 is formed, a connecting portion is formed in correspondence with the difference in diameter between the inserting portion 424 and straight trunk portion 422. The connecting portion has a process surface 423 which is formed at an angle of 45° with respect to the lateral surface of the straight trunk portion 422 and to be used in the preliminary bending process described later. Here, another inclined surface is formed at the edge of one end of the inserting portion 424. This inclined surface is a chamfered portion 425 formed to enable the inserting portion 424 to be smoothly inserted into the upright portion 14. In other words, the outer diameter of the inserting portion 424 is equal to the inner diameter of the upright portion 14 formed in the work 99.

Figure 10:
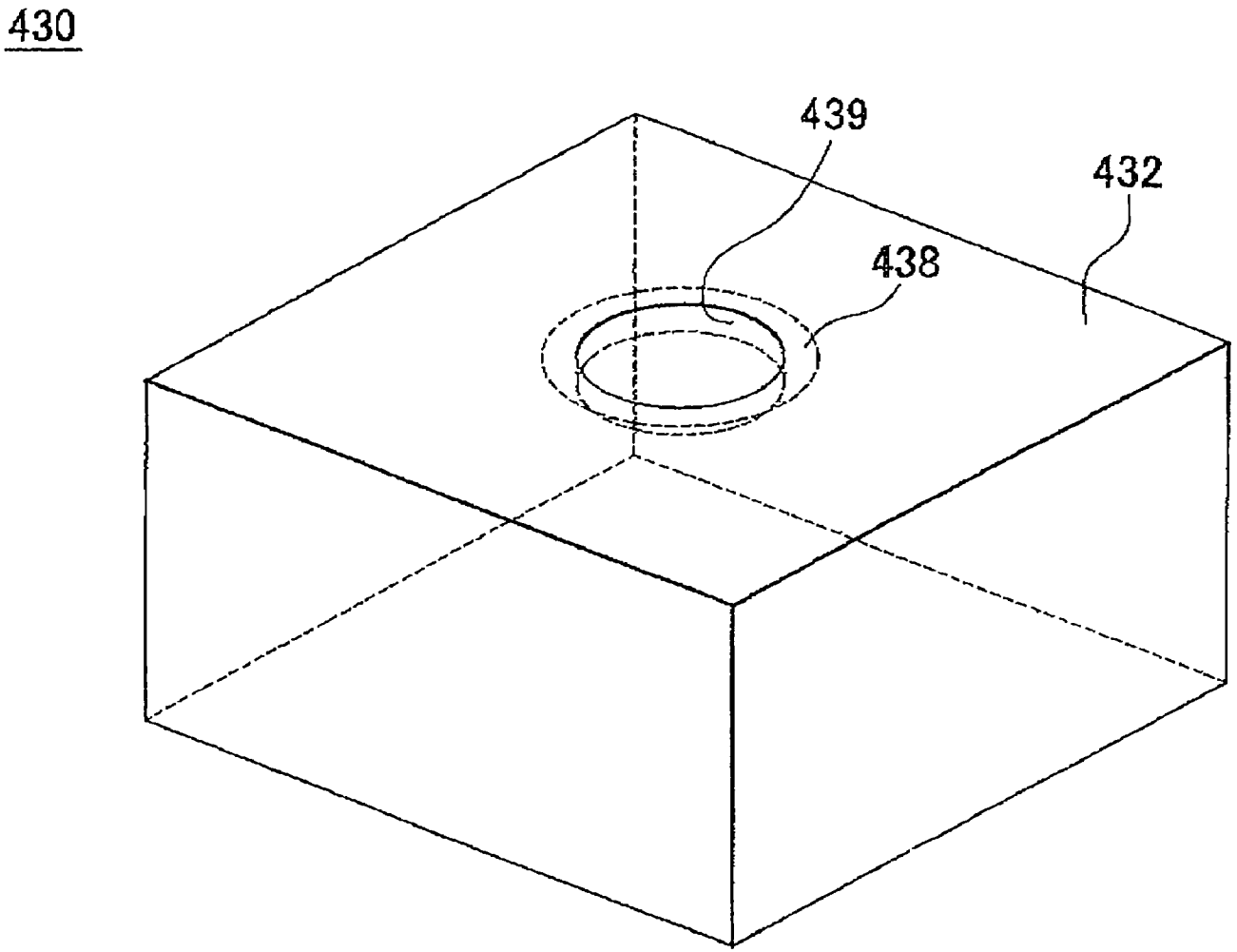
FIG. 10 is a perspective view illustrating the shape of a bending support 430 to be used in the preliminary bending process step and a finishing bending process step.

FIG. 10 is a perspective view illustrating the shape of a bending support 430 which prevents the sheet metal 20 from being unnecessarily deformed when the preliminary bending process is performed by means of the preliminary bending die and punch 410 and 420 shown in FIGS. 8 and 9. As shown in FIG. 10, the bending support 430 is a cubic metal block 432 having a depressed portion 439 formed in the center thereof. Here, the inner diameter of the depressed portion 439 is equal to the outer diameter of the inserting portion 424 of the preliminary bending punch 420.

Figure 11:
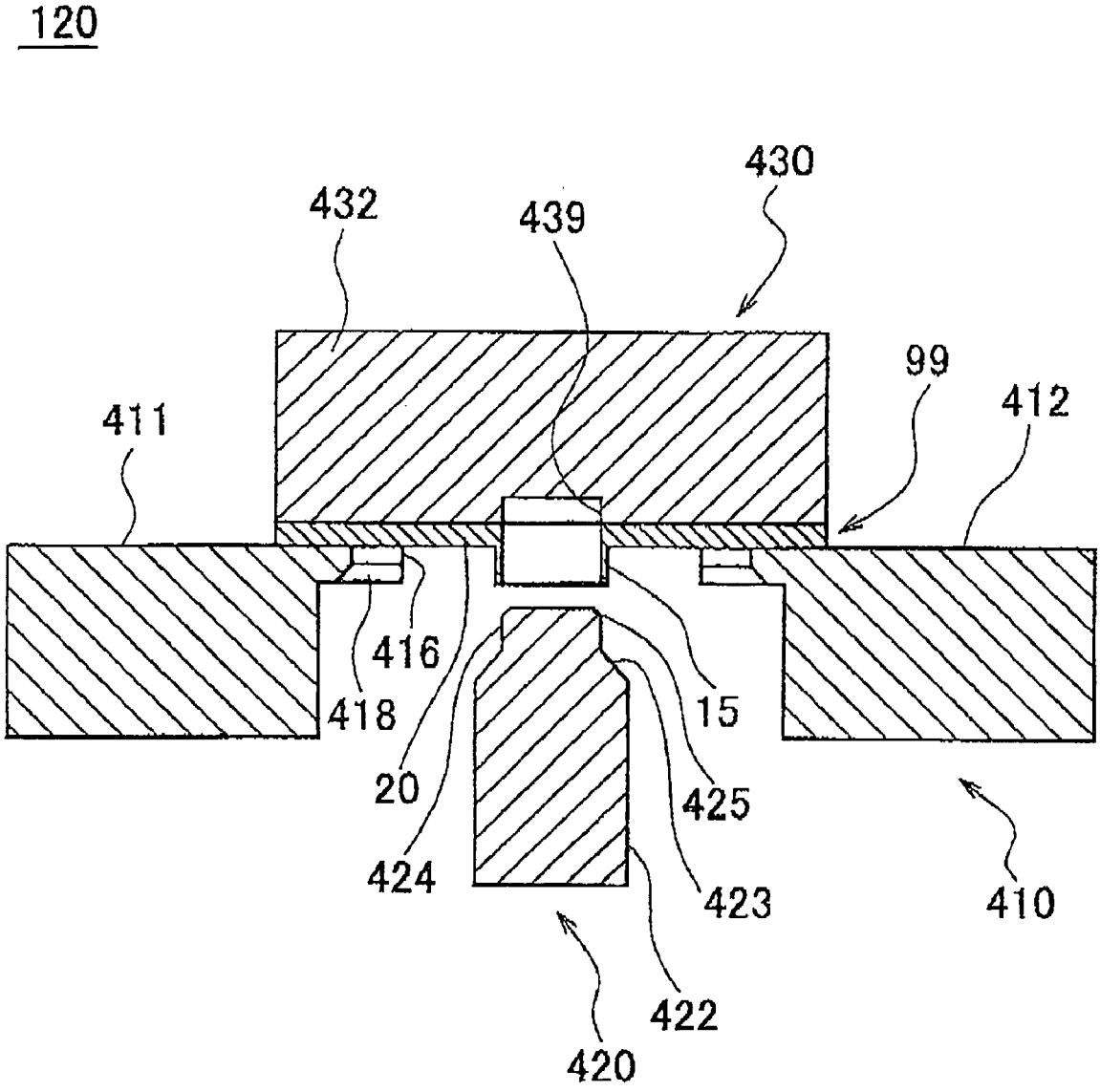
FIG. 11 is a cross-sectional view illustrating the layout of the constituents of a forming apparatus 120 that performs the preliminary bending process step.

FIG. 11 is a cross-sectional view illustrating an operation performed by a forming apparatus 120 to which the preliminary bending die and punch 410 and 420 and bending support 430 shown in FIGS. 8 to 10 are attached. As shown in FIG. 11, the work 99 is placed on the lower surface of the bending support 430 in such a manner that the upright portion 14 formed in the work 99 faces downward. Here, the horizontal position of the work 99 is adjusted so that the inner space of the upright portion 14 and the depressed portion 439 of the bending support 430 are continuously adjacent to each other. In this manner, excluding the upright portion 14, the sheet metal 20 is in a tight contact with the bending support 430, so as to be prevented from being deformed in the upward direction of FIG. 11.

In the forming apparatus 120, the divided dies 411 and 412 constituting the preliminary bending die 410 are positioned so as to oppose each other and both face the lateral surface of the upright portion 14. The preliminary bending punch 420 is positioned below the upright portion 14 so as to face the bending support 430. Note that the depressed portion 439 in the bending support 430 and the inserting portion 424 of the preliminary bending punch 420 are arranged on the same axis.

Figure 12:
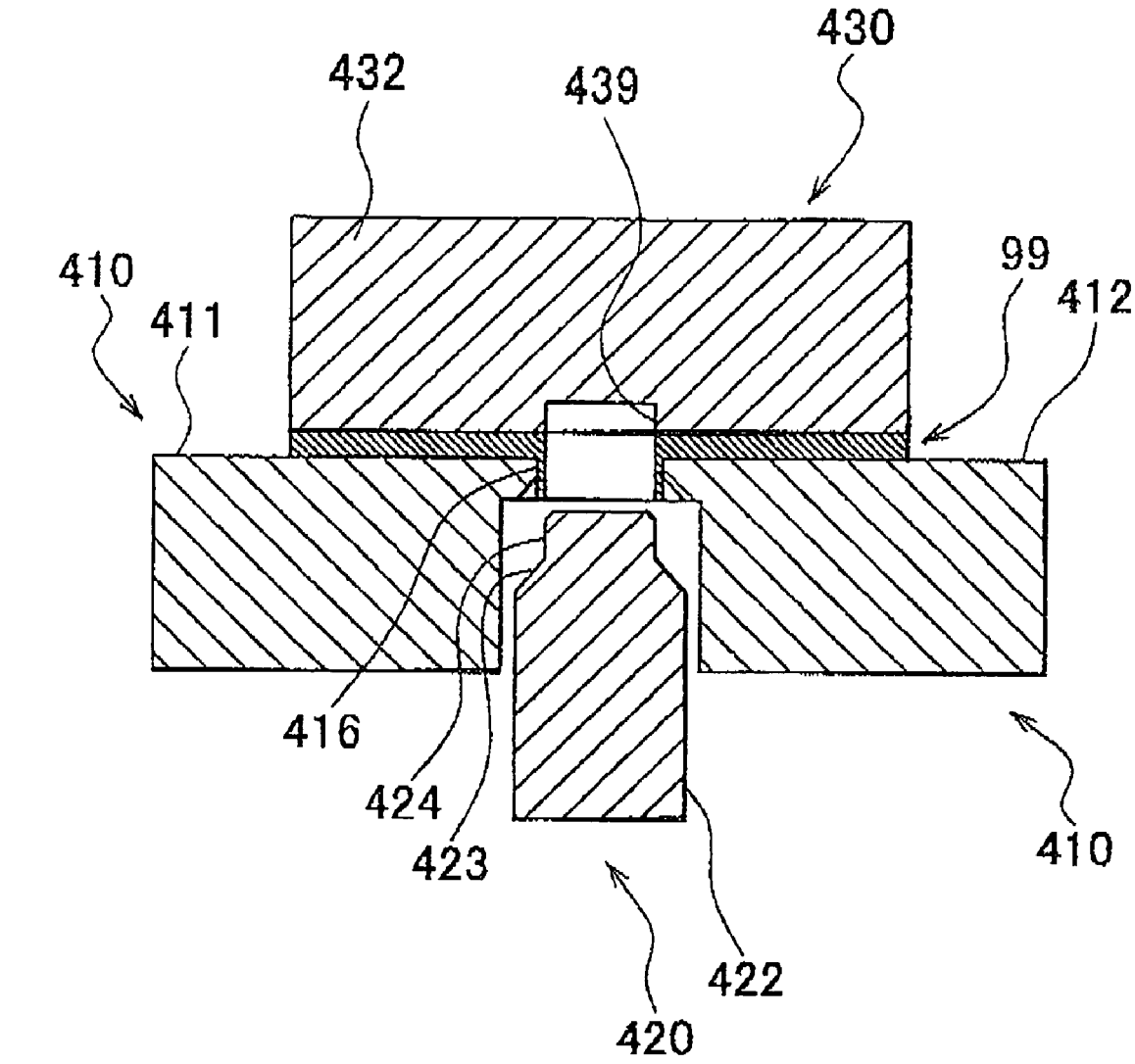
FIG. 12 is a cross-sectional view illustrating a middle operation of the forming apparatus 120 that performs the preliminary bending process step.

FIG. 12 shows that, in the forming apparatus 120 shown in FIG. 11, the divided dies 411 and 412 forming a pair are contacted to each other and the support surfaces 416 are contacted to the upright portion 14. The portion of the upright portion 14 which is in contact with the support surfaces 416 is prevented from being deformed outward. However, it should be noted that the preliminary bending process is not started yet at this stage, and the work 99 is therefore not deformed yet.

Figure 13:
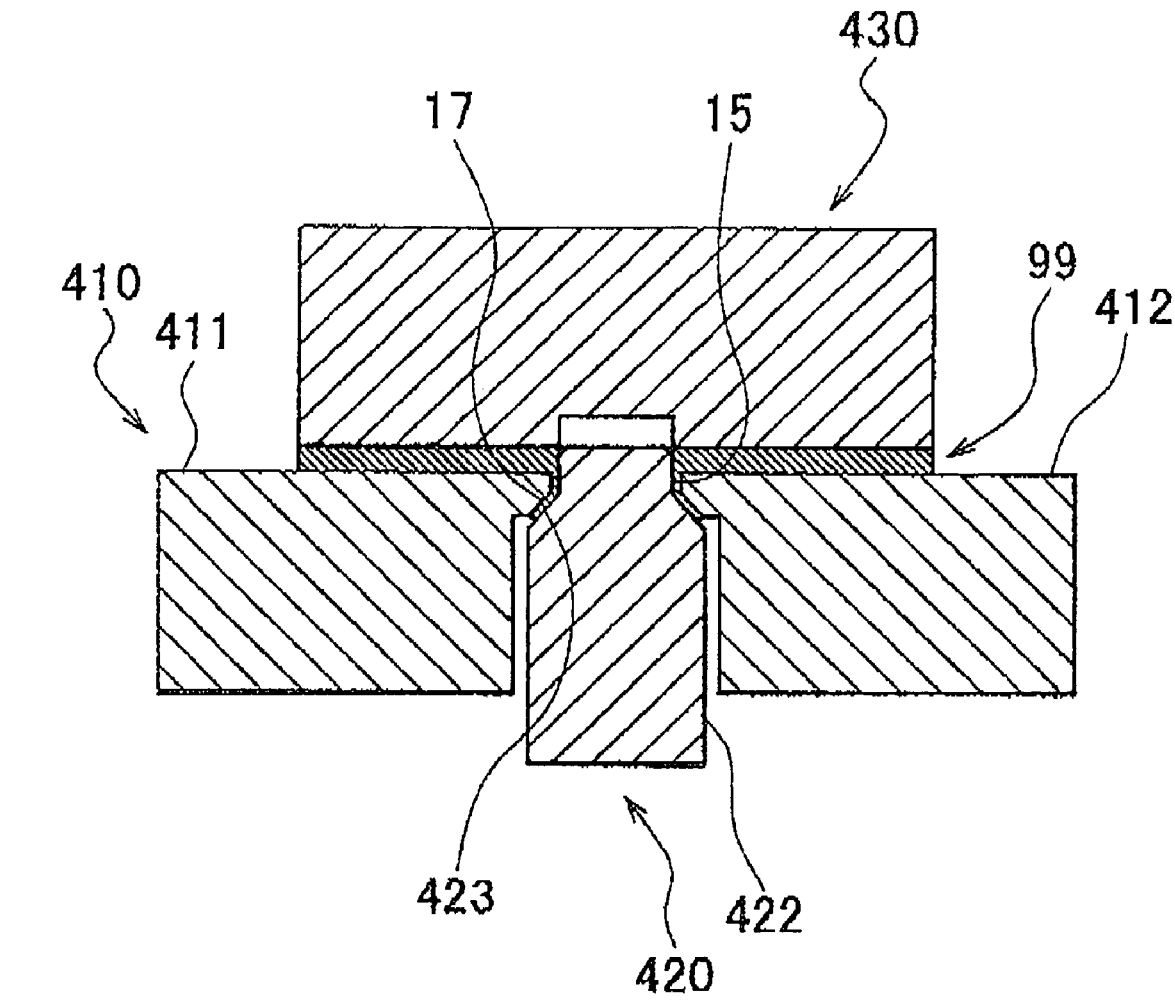
FIG. 13 is a cross-sectional view illustrating a finishing operation of the forming apparatus 120 that performs the preliminary bending process step.

FIG. 13 is a cross-sectional view illustrating that the forming apparatus 120 performs the preliminary bending process by moving upward the preliminary bending punch 420 from the position in FIG. 12. As shown in FIG. 13, the root portion of the upright portion 14 is sandwiched between the lateral surface of the inserting portion 424 of the preliminary bending punch 420 and the support surfaces 416 of the preliminary bending die 410, to be held upright. Meanwhile, the free end portion of the upright portion 14 is pressed against the process surfaces 418 of the preliminary bending die 410 by the process surface 423 of the preliminary bending punch 420, to be bent outward so as to form an angle of 45° with respect to the upright portion 14. As a result, the free end portion of the upright portion 14 forms a flange portion 17. As mentioned above, excluding the free end portion of the upright portion 14, the sheet metal 20 is sandwiched between the bending support 430 and preliminary bending die 410. Therefore, except for the free end portion of the upright portion 14, the sheet metal 20 is not deformed at all even when applied with an external force by the above-described preliminary bending process.

Figure 14:
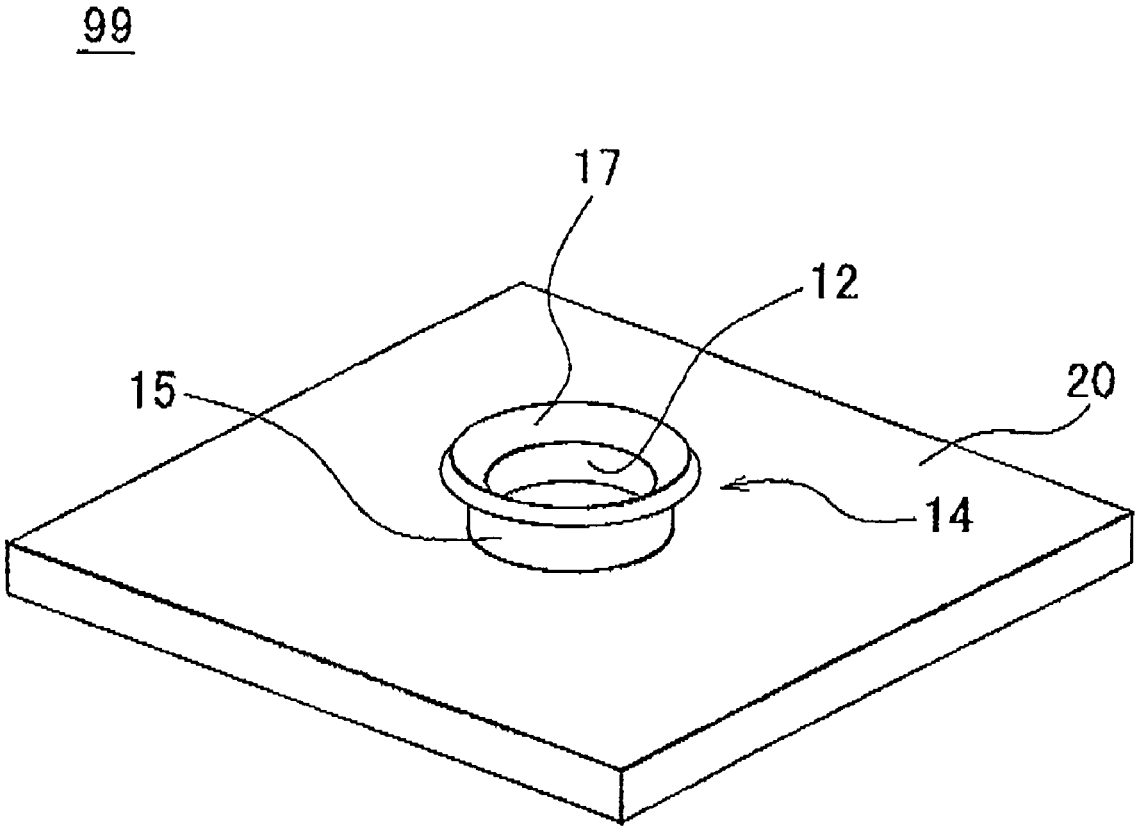
FIG. 14 is a perspective view illustrating the shape of the work 99 which is obtained as a result of the preliminary bending process performed in the preliminary bending process step.

FIG. 14 is a perspective view illustrating the external shape of the work 99 which is obtained as a result of the above-described preliminary bending process. As shown in FIG. 14, the free end portion of the upright portion 14 is bent outward, so as to eventually result in the flange portion 17.

Figure 15:
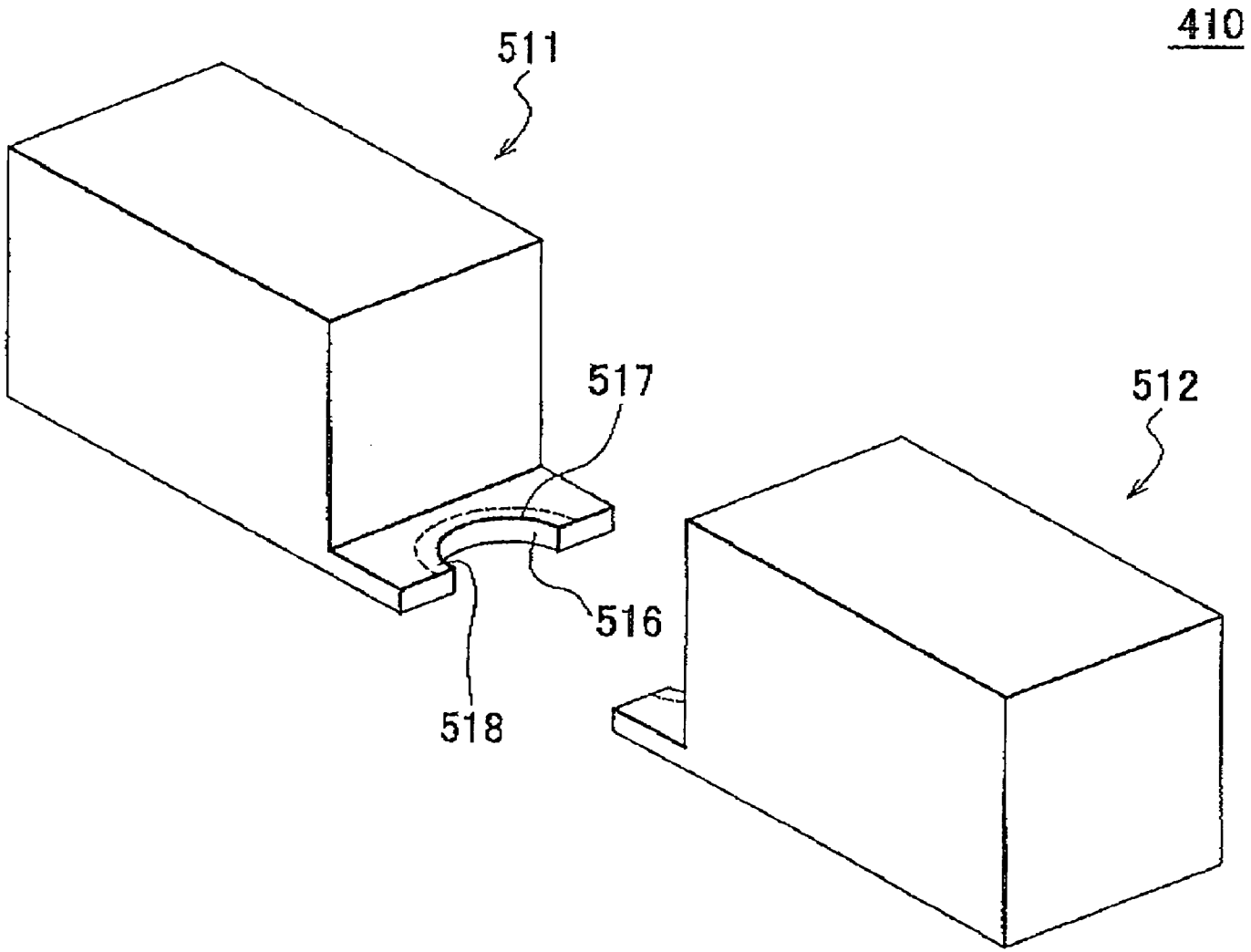
FIG. 15 is a perspective view illustrating the shape of a finishing bending die 510 to be used in a finishing bending process step.

FIG. 15 is a perspective view illustrating the shape of a finishing bending die 510 to be used in the subsequent step to be performed on the work 99. As shown in FIG. 15, the finishing bending die 510 includes a pair of divided dies 511 and 512 each of which has a semicircular support surface 516. When the divided dies 511 and 512 are connected to each other in such a manner that the side surfaces including the support surfaces 516 face each other, a portion of the upper surface adjacent to the support surfaces 516 forms a bending process surface 518. Here, the inner diameter of the space defined by the support surfaces 516 is substantially equal to the outer diameter of the upright portion 14 formed in the work 99.

Figure 16:
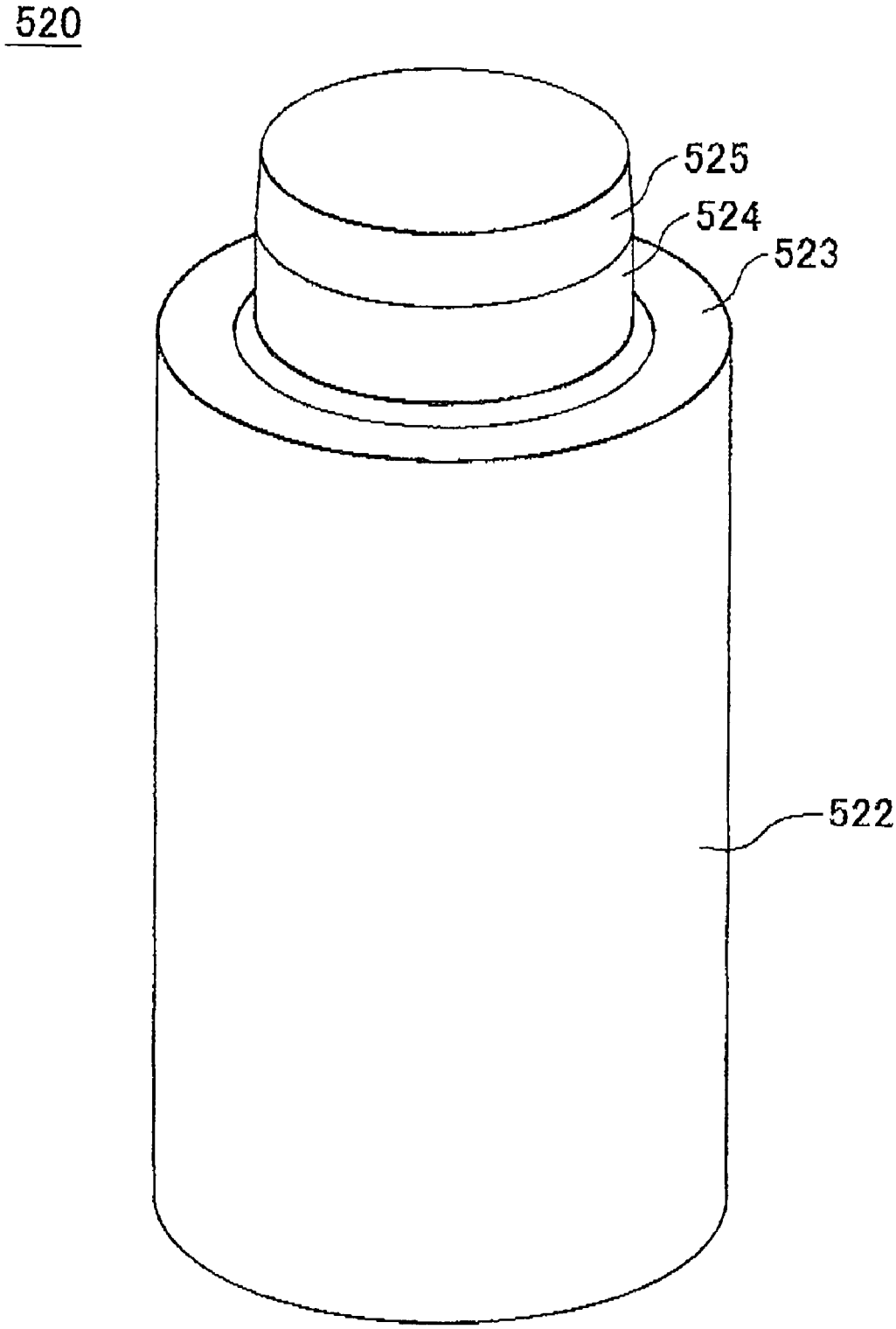
FIG. 16 is a perspective view illustrating the shape of a finishing bending punch 520 to be used in the finishing bending process step.

FIG. 16 is a perspective view illustrating the shape of a finishing bending punch 520 to be used in combination with the finishing bending die 510 described above. As shown in FIG. 16, the finishing bending punch 520 has a circular shape in the horizontal cross-section throughout itself. The finishing bending punch 520 has a cylindrical straight trunk portion 522, and an inserting portion 524 which is formed at one end of the straight trunk portion 522 and has a smaller diameter than the straight trunk portion 522. On the end surface of the straight trunk portion 522 at which the inserting portion 524 is formed, a connecting portion is formed in correspondence with the difference in diameter between the inserting portion 524 and straight trunk portion 522. The connecting portion forms a process surface 523 to be used in the bending process described later. Here, an inclined surface is formed at the edge of one end of the inserting portion 524. This inclined surface is a chamfered portion 525 formed to enable the inserting portion 524 to be smoothly inserted into the upright portion 14. Here, the outer diameter of the inserting portion 524 is equal to the inner diameter of the upright portion 14.

Figure 17:
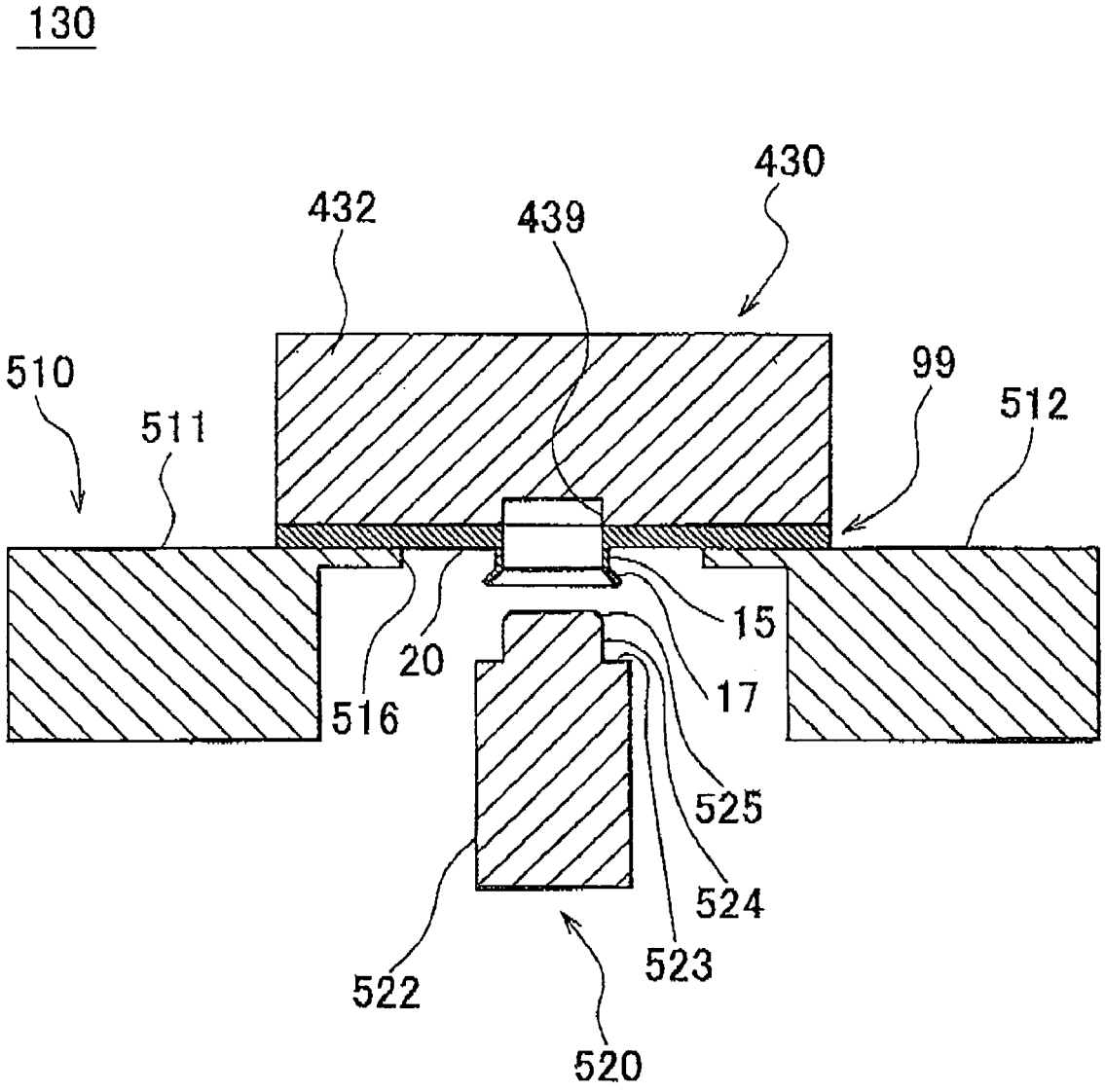
FIG. 17 is a cross-sectional view illustrating the layout of the constituents of a forming apparatus 130 that performs the finishing bending process step.

FIG. 17 is a cross-sectional view illustrating an operation performed by a forming apparatus 130 to which the finishing bending die and punch 510 and 520 shown in FIGS. 10, 15 and 16, and the bending support 430 shown in FIG. 10 are attached. As shown in FIG. 17, the work 99 is placed on the lower surface of the bending support 430 in such a manner that the upright portion 14 faces downward. Here, the depressed portion 439 in the bending support 430 and the space within the upright portion 14 are continuously adjacent to each other. Except for the upright portion 14, the work 99 is in a tight contact with the bending support 430. Therefore, the work 99 is prevented from being deformed in the upward direction in FIG. 17 even when subjected to the finishing bending process described later.

In the forming apparatus 130, the divided dies 511 and 512 constituting the finishing bending die 510 are positioned so as to oppose each other and both face the lateral surface of the upright portion 14. Also, the finishing bending punch 520 is placed below the upright portion 14 so as to face the bending support 430. Here, the depressed portion 439 in the bending support 430 and the inserting portion 524 of the finishing bending punch 520 are arranged on the same axis.

Figure 18:
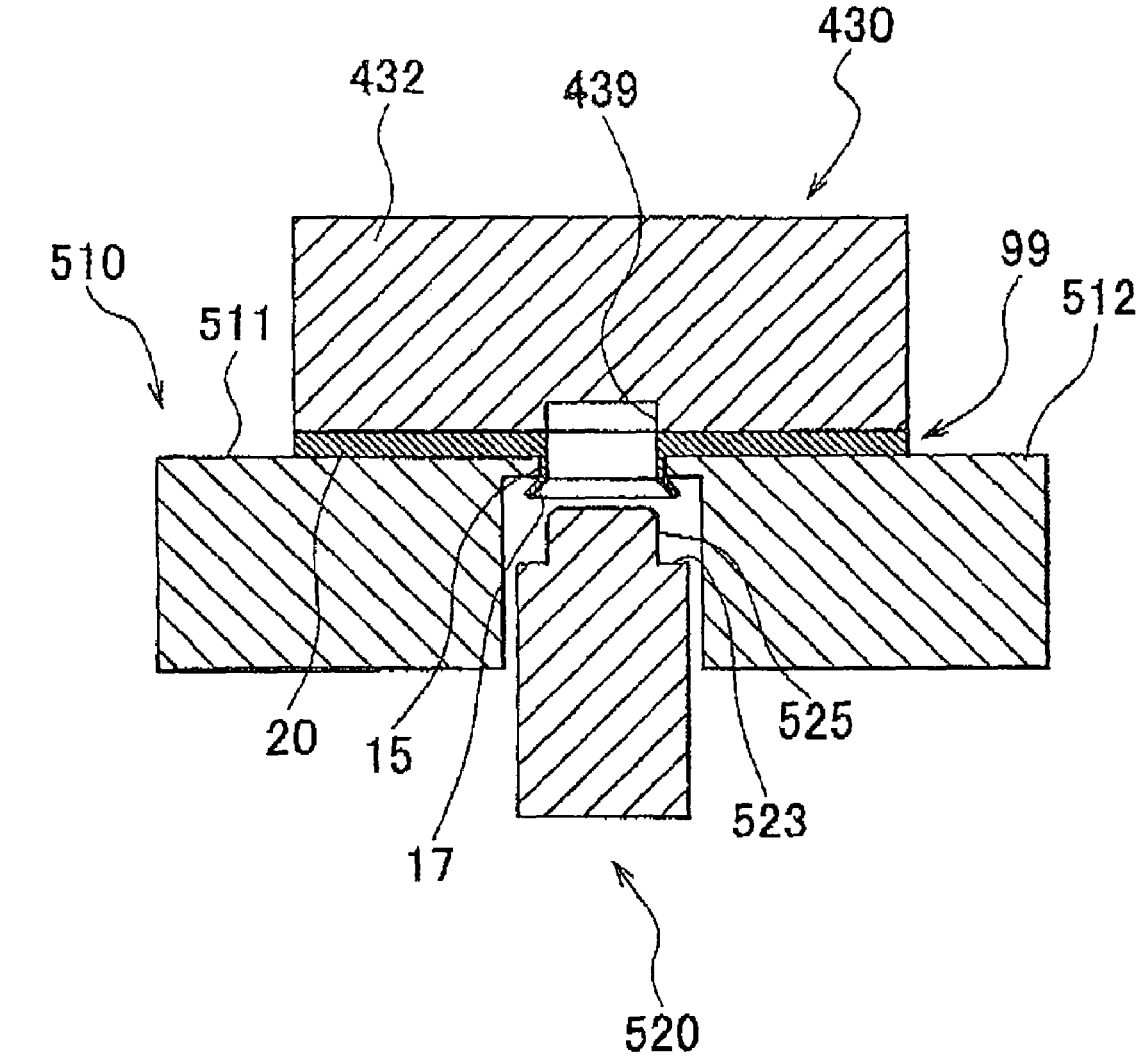
FIG. 18 is a cross-sectional view illustrating a middle operation of the forming apparatus 130 that performs the finishing bending process step.

FIG. 18 illustrates that, in the forming apparatus 130 shown in FIG. 17, the divided dies 511 and 512 forming a pair are contacted to each other and, at the same time, the support surfaces 516 are contacted to the upright portion 14. At this stage, the support surfaces 516 of the divided dies 511 and 512 are in a tight contact with the lateral surface of the not-bent portion of the upright portion 14. Note that, at this stage, the work 99 is not deformed yet and the finishing bending process is not yet started either.

Figure 19:
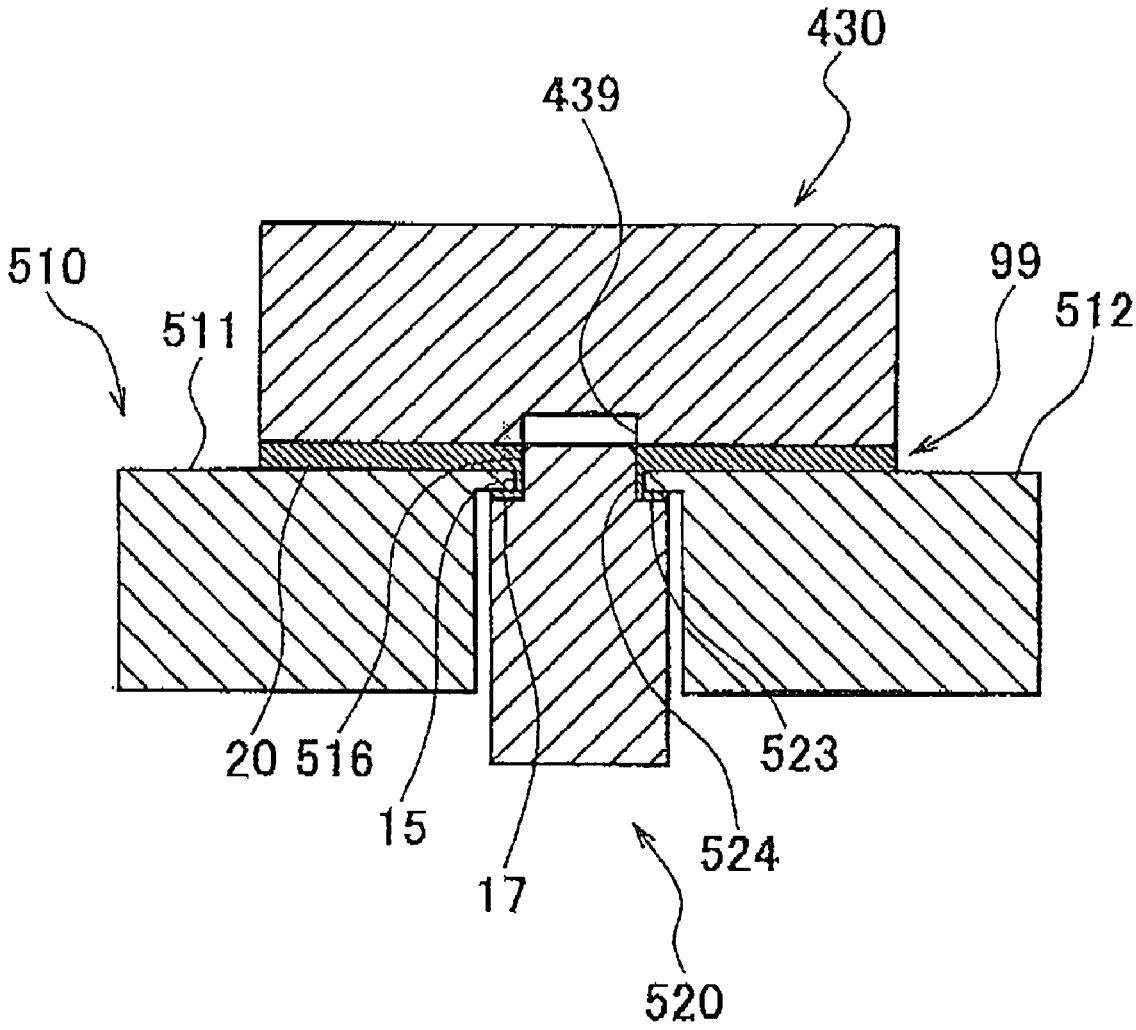
FIG. 19 is a cross-sectional view illustrating a finishing operation of the forming apparatus 130 that performs the finishing bending process step.

FIG. 19 is a cross-sectional view illustrating that the forming apparatus 130 performs the finishing bending process by moving upward the finishing bending punch 520 from the position shown in FIG. 18. As shown in FIG. 19, the root portion of the upright portion 14 is sandwiched between the lateral surface of the inserting portion 524 of the finishing bending punch 520 and the support surfaces 516 of the finishing bending die 510, to be held upright with respect to the surface of the sheet metal 20. Meanwhile, the free end portion of the upright portion 14 is pressed against the process surfaces 518 of the finishing bending die 510 by the process surface 523 of the finishing bending punch 520, to be bent outward so as to form a right angle with respect to the upright portion 14. As mentioned above, except for the free end portion of the upright portion 14, the work 99 is sandwiched between the bending support 430 and finishing bending die 510. Therefore, except for the free end portion of the upright portion 14, the work 99 is not deformed at all even when applied with an external force in the above-described finishing bending process.

Figure 20:
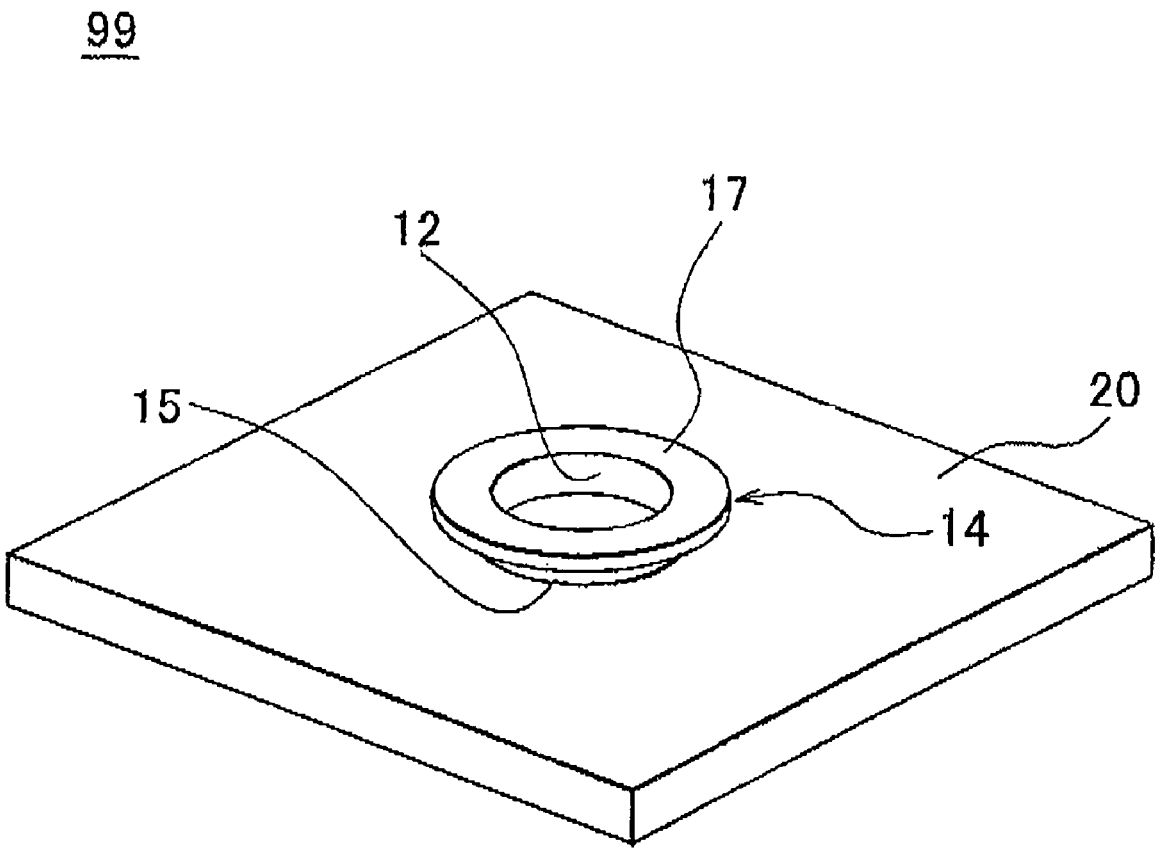
FIG. 20 is a perspective view illustrating the shape of the work 99 which is obtained as a result of the finishing bending process performed in the finishing bending process step.

FIG. 20 is a perspective view illustrating the external shape of the work 99 which is obtained as a result of the above-described finishing bending process. As shown in FIG. 20, the root portion of the upright portion 14 maintains a cylindrical shape 15, and the opening 12 can be used as a socket into which a solid-core shaft is inserted. The free end portion of the upright portion 14 forms the flange portion 17 which extends in parallel with the surface of the sheet metal 20.

As a result of the above-described processing, the opening 12 having a length larger than the thickness of the sheet metal 20 is formed within the upright portion 14 in the work 99. Accordingly, when inserted into the opening, other member is excellently held in the opening. In addition, since the upright portion 14 having the opening 12 formed therein externally has a cylindrical shape, other parts such as a C-clip and an E-clip can be mounted to the external surface of the upright portion 14. Here, the flange portion 17 prevents the part mounted to the external surface of the upright portion 14 from being detached. When the work 99 is mounted to other members, the flange portion 17 may be used as an anchor.

In the foregoing embodiment, the blanking process is performed for forming a preparatory hole in the work 99 prior to the protrusion process step described with reference to FIGS. 4 to 7. However, the blanking process may be omitted if the material used has sufficiently high workability, sufficiently large thickness and the like.

In the present embodiment, the bending process for forming the flange portion 17 includes the preliminary bending process step and finishing bending process step which are separately performed. In other embodiments, however, the preliminary bending process step may be omitted, and only one bending process step may be performed to form the flange.

While one aspect of the present invention has been described through an embodiment, the technical scope of the invention is not limited to the above described embodiment. It is apparent to persons skilled in the art that various alternations and improvements can be added to the above-described embodiment. It is also apparent from the scope of the claims that the embodiments added with such alternations or improvements can be included in the technical scope of the invention.

As clearly indicated by the foregoing description, an embodiment of the present invention can realize a method for forming a hollow shaft to produce a product with a hollow shaft. Also, one embodiment of the present invention can realize a product with a hollow shaft manufactured by the method.

What is claimed is:

1. A method for forming a hollow shaft having a flange portion at an end thereof in sheet metal, the method comprising:

forming a circular preparatory opening in a region of a surface of the sheet metal to which a burring punch is to be contacted;

forming, from the preparatory opening, a cylindrical portion which is open at both ends and upright with respect to the surface of the sheet metal by using the burring punch and a burring die; and bending outward a free end portion of the cylindrical portion, so as to form an upright portion protruding upright with respect to the surface and a flange portion radially extending from an end of the cylindrical portion with respect to a central axis of the cylindrical portion by using a bending punch and a bending die, the free end portion bending including:

bending outward the free end portion of the cylindrical portion so as to form, with respect to the cylindrical portion, an intermediate angle of less than 90°; and further bending outward the free end portion of the cylindrical portion so as to form an angle of substantially 90° with respect to the cylindrical portion, thereby forming the flange portion, wherein throughout the bending, the bending die is partially contacted to a lateral surface of the upright portion to prevent deformation of the lateral surface.

2. The method as set forth in claim 1, wherein in the free end portion bending, a bending support is contacted to a surface of the sheet metal which faces away from the cylindrical portion, so as to prevent deformation of the sheet metal.

3. The method as set forth in claim 1, wherein a distance between the surface of the sheet metal and the flange portion is substantially equal to a thickness of a C-ring to be mounted onto the cylindrical portion.

* * * * *